US008225840B2

(12) United States Patent
Judkins et al.

(10) Patent No.: US 8,225,840 B2
(45) Date of Patent: Jul. 24, 2012

(54) CHILD SAFE CORD LOCK

(76) Inventors: Ren Judkins, Pittsburgh, PA (US); Landon Lee Judkins, Pittsburgh, PA (US)

( * ) Notice: Subject to any disclaimer, the term of this patent is extended or adjusted under 35 U.S.C. 154(b) by 43 days.

(21) Appl. No.: 12/856,102

(22) Filed: Aug. 13, 2010

(65) Prior Publication Data

US 2010/0325843 A1 Dec. 30, 2010

Related U.S. Application Data

(63) Continuation of application No. 11/895,428, filed on Aug. 24, 2007, now Pat. No. 7,775,254, which is a continuation-in-part of application No. 10/725,971, filed on Dec. 2, 2003, now Pat. No. 7,261,138.

(51) Int. Cl.
*E06B 9/324* (2006.01)

(52) U.S. Cl. ..... 160/178.2; 24/134 R; 160/173 R

(58) Field of Classification Search ..... 160/178.2, 160/168.1 R, 173 R; 24/134 R, 134 KB; 114/199; 254/391
See application file for complete search history.

(56) References Cited

U.S. PATENT DOCUMENTS

| | | | | | |
|---|---|---|---|---|---|
| 1,710,697 | A * | 4/1929 | Gilbert | 114/199 |
| 1,951,528 | A * | 3/1934 | Pearson | 24/132 R |
| 2,010,286 | A * | 8/1935 | Wiener et al. | 24/134 KB |
| 2,057,608 | A * | 10/1936 | Carroll | 24/134 KB |
| 2,175,977 | A * | 10/1939 | Stuber et al. | 160/168.1 R |
| 2,575,395 | A * | 11/1951 | Rosenbaum | 24/134 KB |
| 7,261,138 | B2 * | 8/2007 | Judkins et al. | 160/178.2 |
| 7,775,254 | B2 * | 8/2010 | Judkins et al. | 160/178.2 |

* cited by examiner

*Primary Examiner* — Blair M. Johnson
(74) *Attorney, Agent, or Firm* — Buchanan Ingersoll & Rooney PC

(57) ABSTRACT

A cord lock for window coverings has one or more cams adjacent a locking surface over which a one or more lift cords travel. The cams may be spring biased to a locked position in which they press the lift cords against the surface. A release member through which the lift cords pass is provided. Transverse movement of any cord passing through an opening in the release member moves the release member from a first position, in which the cam or cams are in the locked position, to a second position at which a cam engaging portion of the release member engages the cam and the cam is in the unlocked position. Movement of the release member from the first position to the second position maintains the cam in the unlocked position.

15 Claims, 14 Drawing Sheets

CHILD SAFE CORD LOCK

CROSS REFERENCE TO RELATED APPLICATION

This is a continuation-in-part patent application of U.S. patent application Ser. No. 10/725,971, filed Dec. 2, 2003.

FIELD OF INVENTION

The present invention relates to a cord lock for window blinds which are raised and lowered by lift cords such as venetian blinds.

BACKGROUND OF THE INVENTION

Venetian blinds have a headrail, a bottom rail and a set of slats carried on ladders that extend from the headrail to the bottom rail. Lift cords extend from the bottom rail through or adjacent the slats and into the headrail. The lift cords may be wound and unwound on an axle within the headrail, but more commonly pass through a cord lock in the headrail and exit the headrail at one end. Conventional cord locks will restrain the lift cords when the blind is in a fully raised, or partially lowered, position. But, typically those cord locks do not lock the cords in place when the blind is fully lowered. Consequently, anyone can grasp a lift cord of a fully lowered blind and pull the lift cord away from the blind until the end of the lift cord, which typically has a tassel, reaches the end of the headrail. When a lift cord is pulled in this way a loop is formed. Children have been known to do this. Indeed, some children have become entangled in a cord loop created in this way and have been strangled. Consequently, the industry has been encouraged to provide safety devices on venetian blinds to prevent cords from being pulled away from the slats. A similar problem can also occur in pleated shades and roman shades.

One solution to this problem that some manufacturers have adopted is to attach a cord stop to each lift cord. One type of cord stop has a donut shape. The lift cord is passed through the center hole and around the body. This type of cord stop is disclosed in U.S. Pat. No. 6,453,971. Another type of cord stop is a ball with a slot that snaps onto the cord. Even though the cord stops that have been used are made from clear plastic, they are quite noticeable and detract from the appearance of the blind. Furthermore, one stop must be attached to each lift cord by the installer after the blind has been mounted on the window. This adds several minutes to the installation of a single blind. Fabricators and installers who install cord stops on their blinds must spend more time on each job thereby increasing the cost of the installation.

There is a need for a mechanism that can be used in venetian blinds and other window coverings that will prevent lift cords from being pulled away from a fully lowered blind. That mechanism should not detract from either the operation or appearance of the blind.

U.S. Pat. No. 5,275,222 discloses a cord lock and release system for blinds having a stationary member and a moveable member between which the lift cords pass. In the preferred embodiments a spring biases the moveable member toward the stationary member to restrain the lift cords. A linkage, which typically is a release cord, is attached to the moveable member. The operator pulls the release cord to move the movable member away from the stationary member to release the lift cords. Since the moveable member is biased to the locked position the cords will normally be restrained. The patent also teaches that a spring is not required and that gravity could keep the moveable member in a locked position. But, without the spring, the moveable member is free to rotate 360° and become stuck in a release position. Even the spring biased system permits rotation of the moveable member through an arc greater than 90°. Another shortcoming of this system is that a single moveable member is provided to restrain all of the lift cords. Lift cords often vary in diameter within a single blind by a few thousandths of an inch. If two lift cords in a blind vary in diameter the movable member in a locked position will restrain the larger diameter cord but may allow the smaller diameter cord to slip past the moveable member. Consequently, there remains a need for a cord lock or other system that will prevent lift cords from being pulled away from a fully lowered blind and not detract from either the operation or appearance of the blind.

SUMMARY OF THE INVENTION

We provide a cord lock having one or more cams adjacent a locking surface over which a one or more lift cords travel. The cams may be spring biased to a locked position in which they press the lift cords against the surface. A release member through which the lift cords pass is provided. Movement of any cord passing through an opening in the release member moves the release member from a first position, in which the cam or cams are in the locked position, to a second position at which a cam engaging portion of the release member engages the cam and the cam is in the unlocked position. Movement of the release member from the first position to the second position maintains the cam in the unlocked position.

Our cord lock has a generally rectangular housing containing a locking surface over which one or more lift cords pass. In the preferred embodiments the surface is curved. We also prefer to provide one cam for each lift cord. The cams can rotate about a first axis from at least one unlocked position to a locked position, and from the locked position to the unlocked position. The surface is spaced apart from the cam such that a cord passing over the surface will be pressed against the surface and restrained when the cam is in the locked position, and the cord can freely pass over the surface in at least one direction when the cam is in the unlocked position.

The housing may include one or more turning surfaces adjacent the cord path. In one embodiment, the turning surfaces are generally cylindrical posts. Triangular extensions may also be attached to the housing adjacent the cord path.

In certain preferred embodiments we provide a cam lock within the housing that is capable of assuming a first position in which the cams are in the locked position, and at least one additional position in which the cams are engaged by the cam lock and in an unlocked position. The cam lock limits the travel of the cams through an arc that is preferably less than 90°.

The cam lock can be variously configured. In one embodiment the cam lock is a box-like carriage. In another preferred embodiment the cam lock is a pair of interlocking drums. In yet another embodiment the cam lock is a single wheel having a slot into which the cams are fitted. In still another embodiment the cam lock is a generally U-shaped housing that extends around the pivoting end of the cams.

A release cord is attached to the cam lock in a manner so that pulling the release cord moves the cam lock to engage and move the cams from the locked position to a release position in which the lift cords can freely move through the cord lock. One or more springs are attached to the cam lock, to the axle carrying the cams or directly to the cams, biasing the cams to the locked position. The spring has a strength that enables the cams to move from the locked position to the unlocked positions when an operator pulls the lift cords to raise the blind or pulls the release cord to lower the blind.

Other objects and advantages of our cord lock will become apparent from a description of certain present preferred embodiments shown in the drawings.

DETAILED DESCRIPTION OF THE PREFERRED EMBODIMENTS

Figure 1:
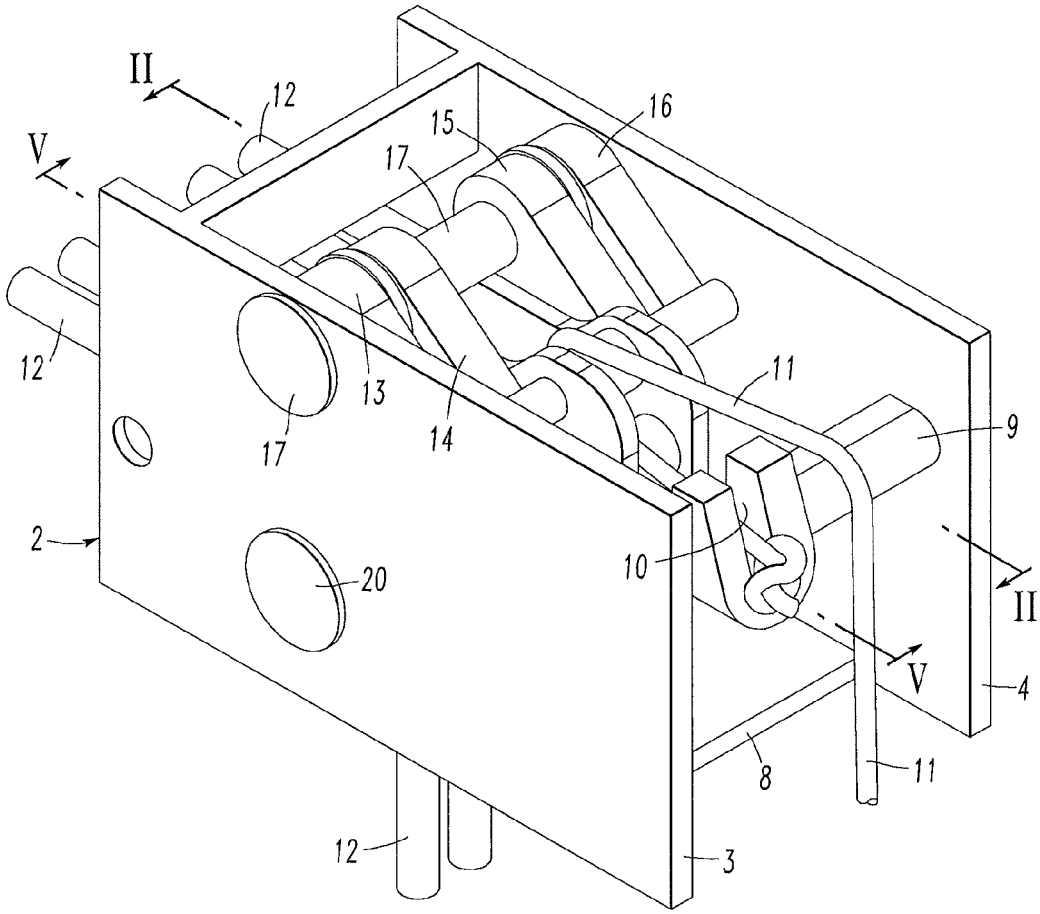
FIG. 1 is a perspective view of a first present preferred embodiment of our cord lock.

A first present preferred embodiment of our cord lock 1, shown in FIGS. 1 through 6, has a housing 2 formed from two spaced apart parallel sides 3 and 4 held together by front walls 5 and 6, bottom walls 7 and 8 and spacer 9. An inverted keyhole slot 10 is provided in the spacer 9 through which a release cord 11, shown only in FIG. 1, passes. The cord lock shown in FIGS. 1 though 6 is configured to accommodate four lift cords 12. As will be seen, other configurations could be provided to receive two, three, five, six or even more cords. However, for blinds having eight or more lift cords we prefer to use two or more cord locks.

Figure 2:
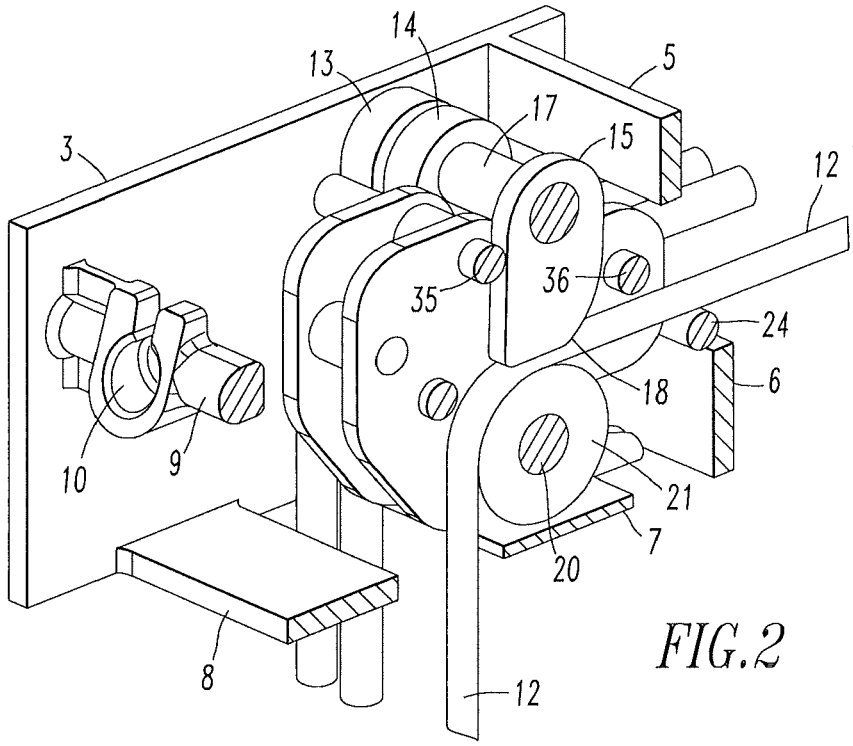
FIG. 2 is a sectional view along the line of FIG. 1 showing the cord lock in a locked position and having no release cord.
Figure 3:
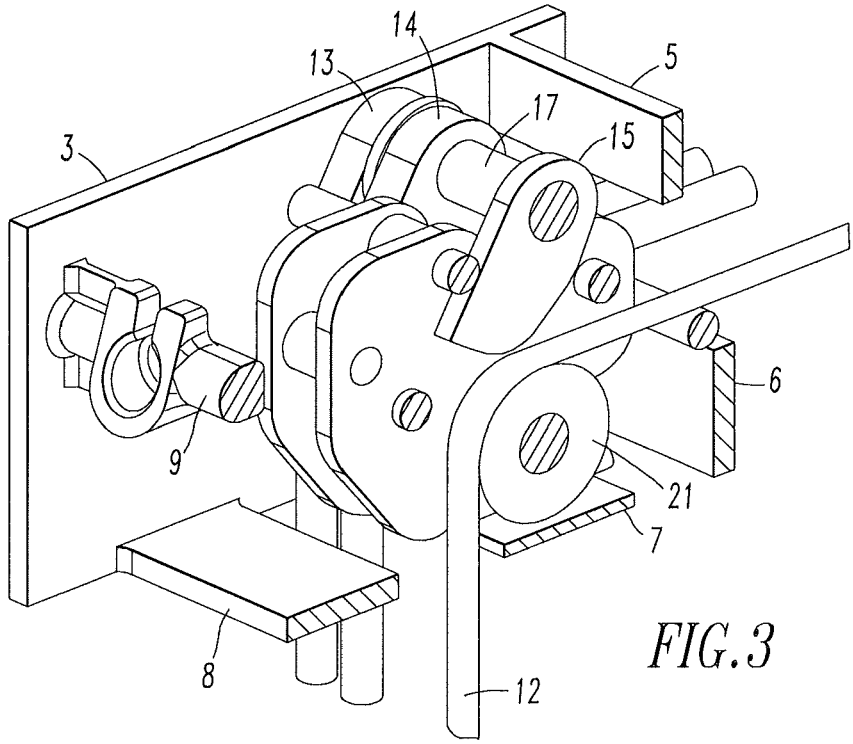
FIG. 3 is a sectional view similar to FIG. 2 showing the cord lock in a first unlocked position.
Figure 4:
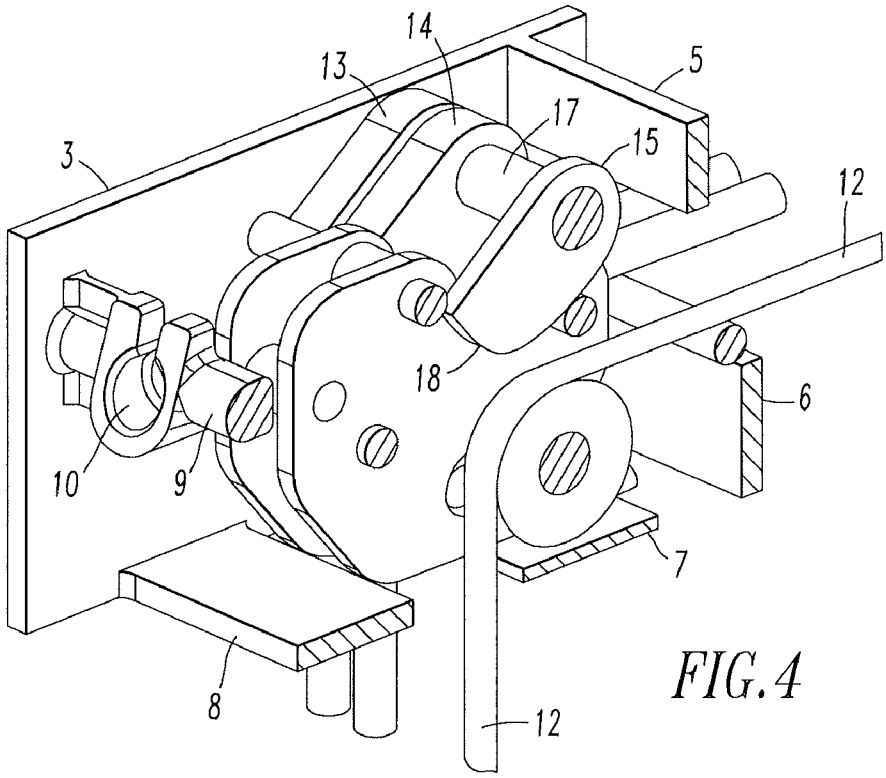
FIG. 4 is a sectional view similar to FIGS. 2 and 3 showing the cord lock in a second unlocked position or release position.
Figure 5:
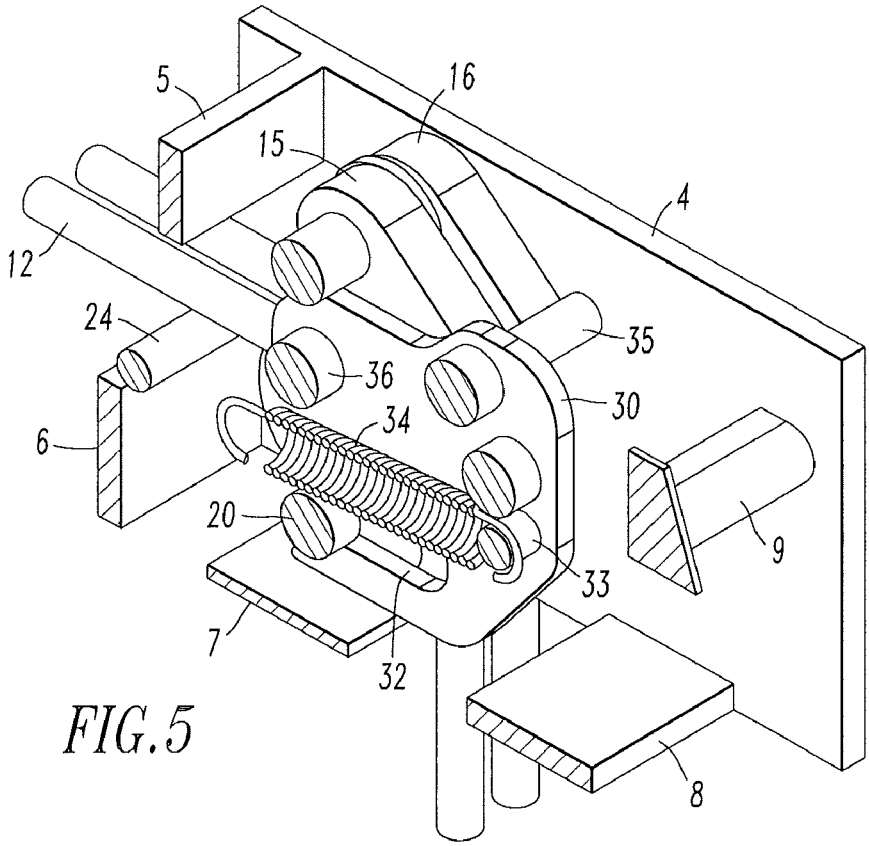
FIG. 5 is a sectional view taken along the line V-V of FIG. 1 showing the cord lock in the unlocked position shown in FIG. 4.
Figure 6:
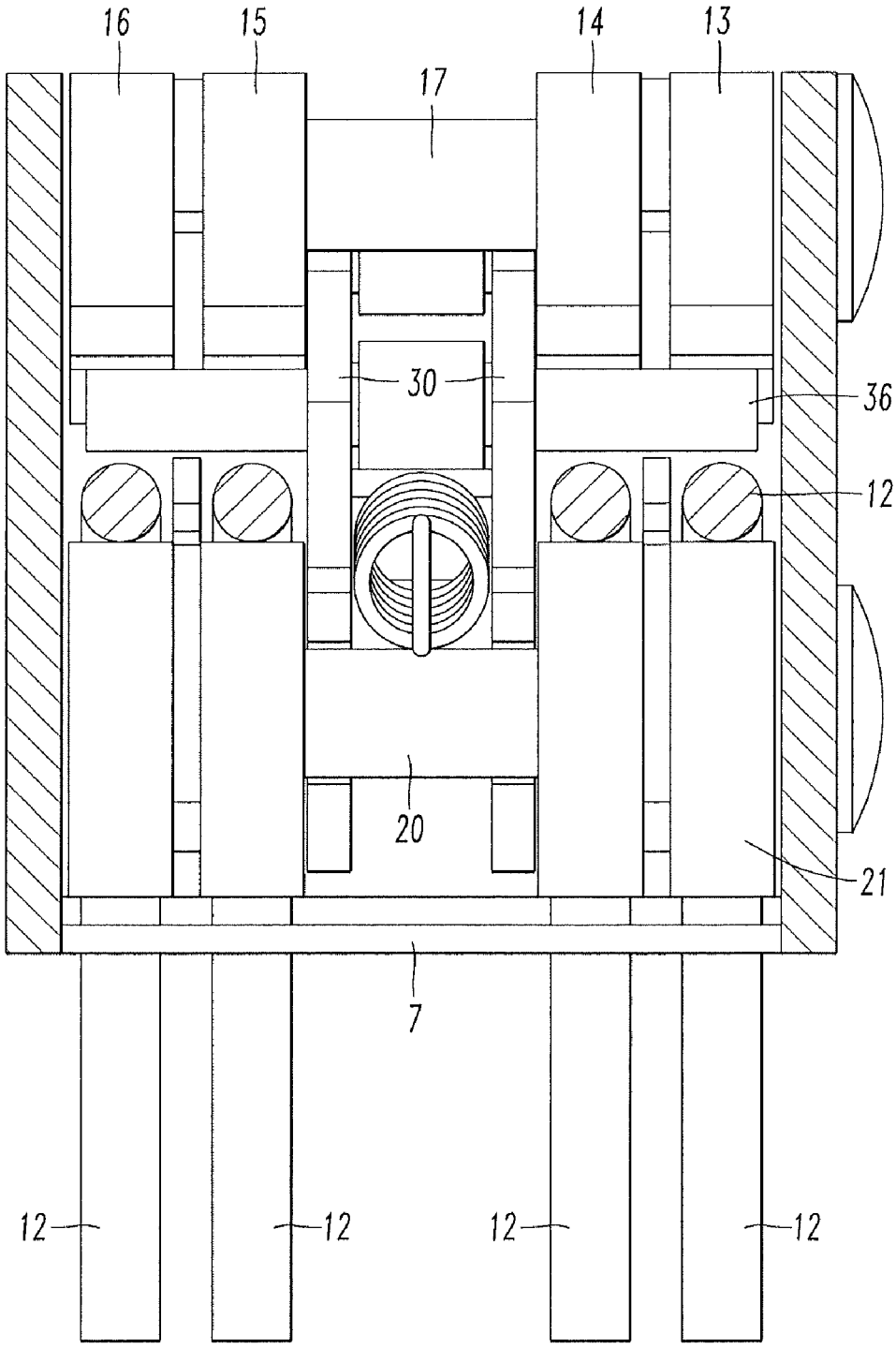
FIG. 6 is a sectional view taken along the line VI-VI in FIG. 1.

The operation of the cord lock can best be understood with reference to FIGS. 2, 3, and 4. Within the cord lock housing 2 we provide four cams 13, 14, 15 and 16 on a common pin 17 that passes through the housing. There is one cam for each lift cord 12. All of the cams rotate on a common axis defined by pin 17. We prefer to provide teeth or a serrated edge 18 on each cam which engage a lift cord 12 when the cam is in a locked position shown in FIG. 2. A second pin 20 passes through the housing 1 and is parallel to pin 17. Pin 20 carries a wheel or roller 21 over which the lift cord 12 rides. We prefer to provide a separate wheel for each cam, but a common roller could be used for all cams 13 through 16. If desired, a spacer can be placed between adjacent wheels and adjacent cams. Those spacers could extend to the front walls 5 and 6 of the cord lock. Furthermore, the wheels 21 could simply be fixed curved surfaces that do not move as a lift cord 12 passes over them. The relative positions of the cams 13 through 16 and the wheels 21 define cord paths between them through which the lift cords travel. The lift cords 12 enter the cord lock 1 between front walls 5 and 6 after passing from the window covering material. They pass over spacer rod 24, over wheel 21 and exit the cord lock between bottom walls 7 and 8. When the cams 13 through 16 are in the locked position shown in FIG. 2, each lift cord is pinched between a cam and a roller and the teeth 18 on each cam press into the cord. If one pulls on a lift cord where the cord passes through the blind slats or other window covering material, the cord will not move. Hence, a child pulling a lift cord away from the window covering material in a fully lowered blind could not create a loop in the cord. The lift cord would not move. Furthermore, the bottom rail of the blind cannot be lowered when the cams are in the locked position shown in FIG. 2. To raise the blind an operator pulls on the portion of the cord below the bottom of the cord lock. As can be seen in FIG. 3 that force turns wheel 21 and moves the cam to a first unlocked position. As the lift cords 12 are pulled to raise the blind, the cams ride on the lift cords. When the operator releases the lift cords the weight of the blind causes the lift cords to move in the opposite direction. As that motion begins the teeth 18 in the cams quickly engage the lift cords locking the blind in place. Once again the blind is in the locked position shown in FIG. 2. Teeth 18 should be angled to enable the cord to be easily released when pulled by the operator.

A movable cam lock or carriage 30, positioned between cams 14 and 15, has a slot 32 that enables the carriage to move back and forth over pin 20. A spring 34 is connected between pin 33 in the carriage and rod 24 biasing the carriage 30 to the locked position of FIG. 2. Pins 35 and 36 extend through the carriage 30 toward the sidewalls 3 and 4 of the housing 2. The pins 35 and 36 are positioned to capture the cams 13, 14, 15 and 16 between them. Consequently, the cam lock limits the movement of the cams. Movement of the carriage from the locked position shown in FIG. 2 to the release position shown in FIG. 4 will engage and move the cams 13, 14, 15 and 16 to a second unlocked position. Since the cams are now away from the lift cords those cords are free to move in either direction. Unless the lift cords are being held by the operator, the weight of the shade will pull the lift cords through the cord lock until the bottom rail hits the window sill or is otherwise restrained. The carriage can be moved to the release position by pulling on the release cord 11 shown in FIG. 1.

Having explained the operation of the cord lock, it should now be apparent how a blind equipped with our cord lock is operated. To raise the blind, an operator pulls the lift cords. To lower the shade, the operator pulls the release cord. It is not necessary to move the lift cords to one side through a plane parallel to the blind or through a plane perpendicular to the blind to lock or unlock the cord lock. This is another advantage over many conventional cord locks.

Figure 7:
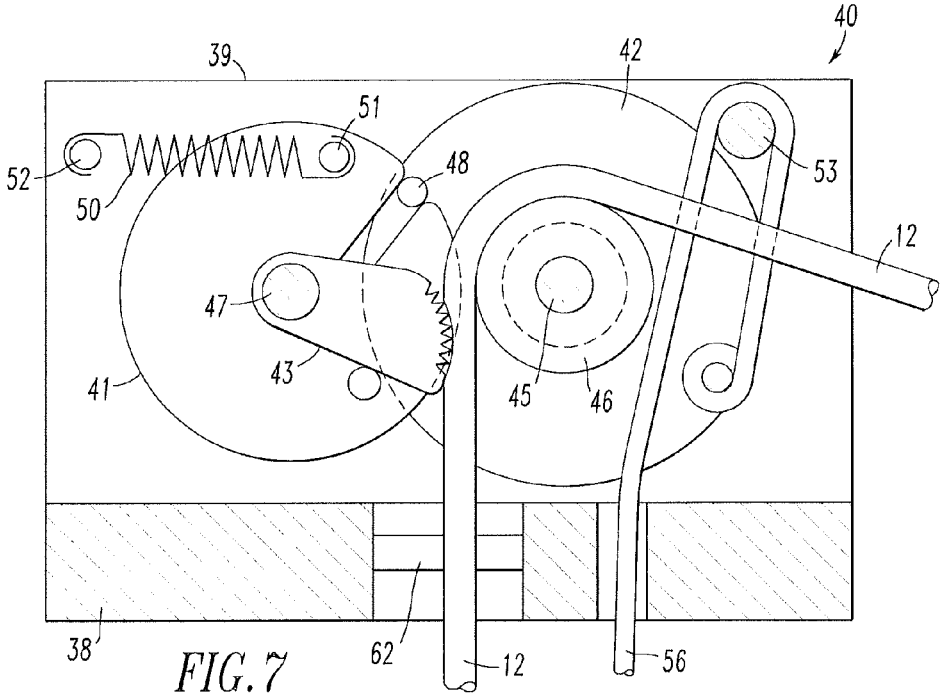
FIG. 7 is a sectional view similar to FIG. 2 of a second present preferred embodiment of our cord lock in a locked position.
Figure 8:
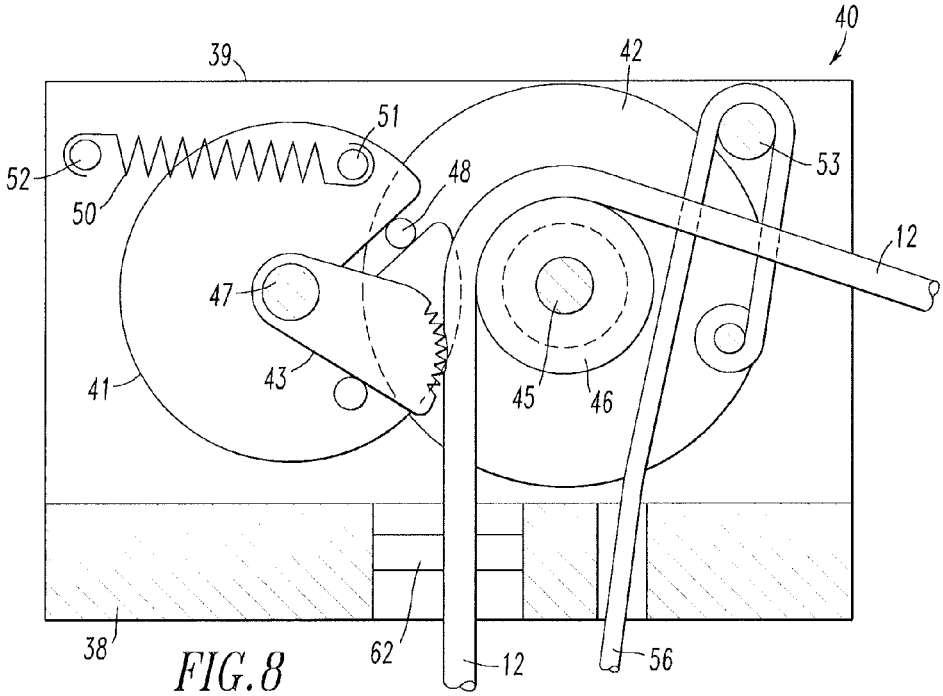
FIG. 8 is a sectional view similar to FIG. 7 of the second present preferred embodiment of a cord lock in a first unlocked position.
Figure 9:
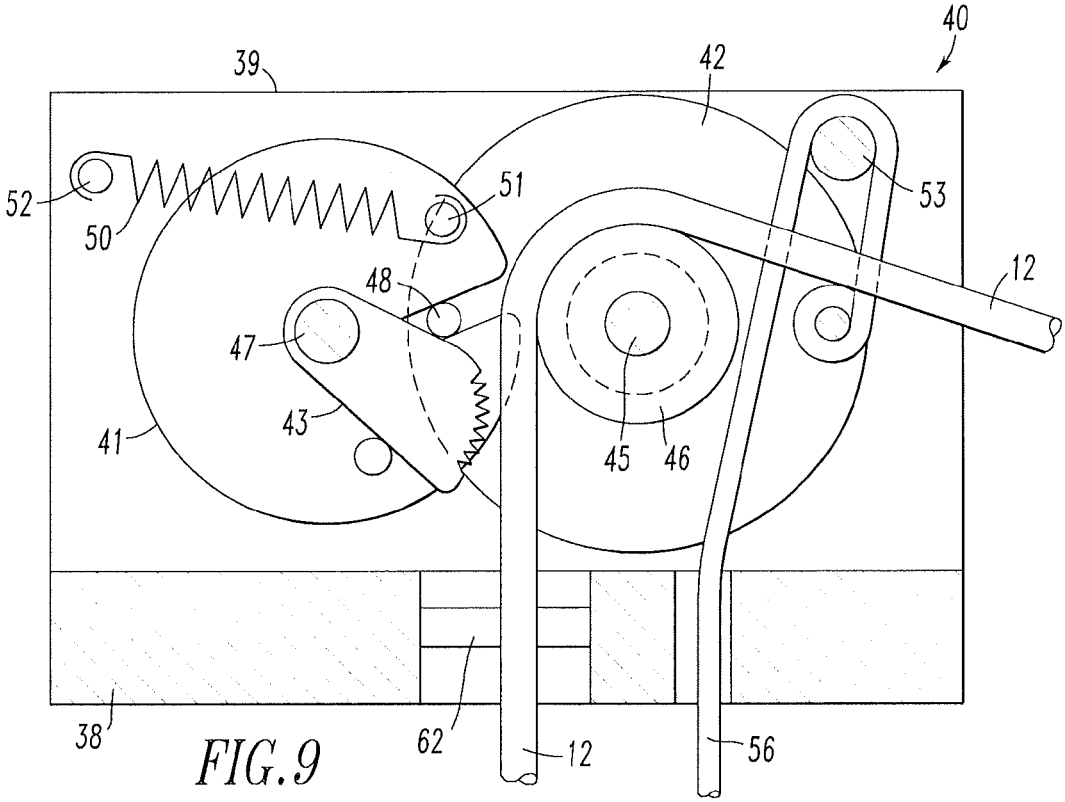
FIG. 9 is a sectional view similar to FIGS. 7 and 8 showing the second present preferred cord lock in a second unlocked position or release position.

In a second present preferred embodiment of our cord lock 40, shown in FIGS. 7, 8 and 9, the cam lock contains a pair of locking drums 41 and 42 in place of the carriage 30 of the first embodiment. In this embodiment, pin 47 extends through the housing 39 and carries the first locking drum 41 and four cams 43, two on each side of the locking drum 41. A second pin 45 extends through the housing and carries second locking drum 42 and two wheels 46, two on each side of the second locking drum. As in the first embodiment, a lift cord 12 passes between each set of cams and wheels. A slot 49 is provided in the first locking drum 41 which receives a pin 48 in the second locking drum 42. This slot and pin arrangement causes the two locking drums to move together. A spring 50 extends from pin 51 on the first locking drum 41 to a pin 52 extending from the housing as shown in FIG. 8. This biases the locking drums to the locked position shown in FIG. 7. If desired the spring could be connected between the second locking drum and the housing. A release cord 56 extends from pin 54 on locking wheel 42, passes over rod 53 and exits the bottom of the cord lock. The bottom 38 of the housing has a passage 60 through which the lift cords 12 pass. We prefer to provide guide pins 62 in the passage 60 to separate adjacent lift cords. Pulling the lift cords from below the cord lock moves the cams to an unlocked position shown in FIG. 8. Pins 51 and 54 extend through the first locking wheel 41 and capture the cams 43. Pulling the release cord turns both locking wheels 41, 42 until pin 51 moves the cams away from the lift cords to an unlocked position or release shown in FIG. 9. The drums need not be round but could be a polygon or have an irregular or non-symmetric shape.

Several variations could be made in the embodiments illustrated in FIGS. 1 through 9. In both versions of the cord lock a spring was connected between the housing and the cam lock, namely carriage 30 or locking drum 41 or 42. In an alternative embodiment one could attach the spring indirectly to the cams by a connection to the rod carrying the cams, particularly if the cross section of the rod is a polygon. The spring could directly engage the cams or one could provide individual springs for each cam. The use of individual springs for each cam enables each cam to move independently, thereby compensating for variations in the diameters of the cords. However, use of multiple springs is more expensive than the single spring embodiments shown in the drawings.

Figure 10:
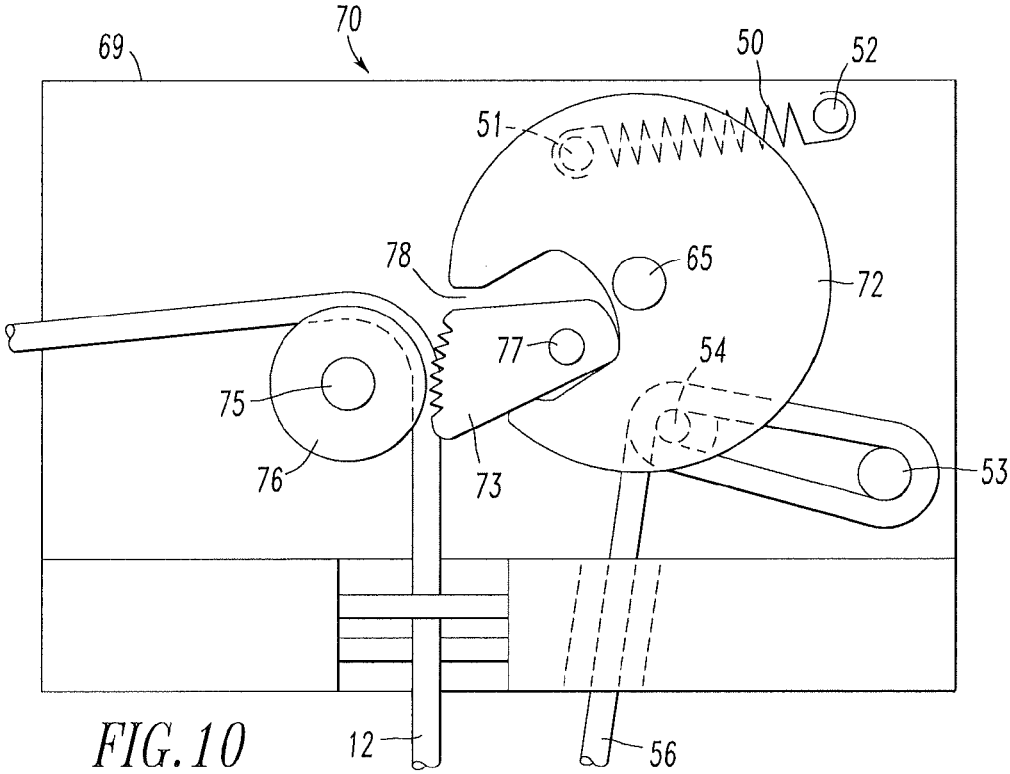
FIG. 10 is a sectional view similar to FIG. 7 of the third present preferred embodiment of our cord lock in a locked position.
Figure 11:
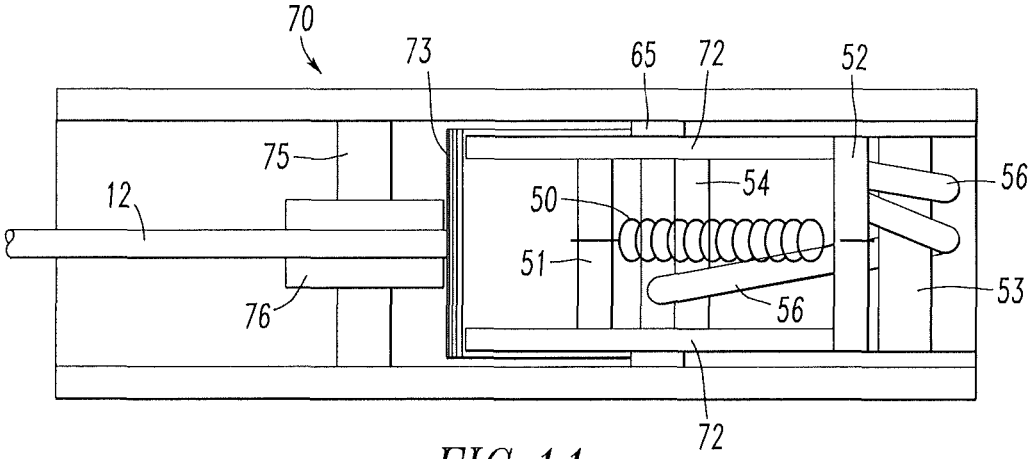
FIG. 11 is a top plan view of the third present preferred embodiment shown in FIG. 10.

The third present preferred embodiment of our cord lock 70 shown in FIGS. 10 and 11 is similar to the second embodiment. A cam lock wheel 72 is carried on axle 65 extending from housing 69. A second axle 75 carriers wheel 76 over which one or more lift cords 12 travel. Again we prefer to have a separate wheel for each lift cord. Cams 73 are carried on pin 77 and captured within a slot 78 in the cam lock wheel 72. As in the previous embodiment spring 50 biases the cam lock wheel 72 to the locked position shown in FIG. 10. Release cord 56 is attached to cam lock wheel 72 by pin 54 and travels around pin 53 before exiting the cord lock. As can be seen from the top view of the cord lock 70 in FIG. 11 this cord lock can be quite narrow. Consequently, two or even three cord locks can be placed side by side within the headrail.

A fourth present preferred embodiment of our cord lock 80 is shown in FIGS. 12 through 15. This cord lock 80 has a base 81 from which wall 82 extends. A second wall 83 is attached to the base 81 and wall 82. As can be most clearly seen in FIG. 15, wall 83 has a slot 92 through which the lift cords 12 pass. The bottom edge 93 of that slot is angled relative to the base 83 and serves as a ramp. Axle 84 extends from wall 83 and carries cams 85 as well as bell-shaped cam lock 86. The cam lock 86 may be spring biased to the locked position shown in FIG. 12 or may be configured so that gravity pulls the cam lock to the locked position. The cams 85 are sufficiently away from the leading edge of bell-shaped cam lock 86 and wall 83 that an operator may move the lift cords 12 up ramp 93 from the position shown in dotted line in FIG. 15. This motion causes the leading edge of the cam lock 86 to rise moving the cams to the release position shown in FIG. 14. As in the previous embodiments the cam lock 86 allows the operator to pull the lift cords to raise the blind. When that happens the cams will be positioned as in FIG. 13. This cord lock is configured to fit into the end of a headrail. We prefer to provide a cover 88 over the slot 92 through which the lift cords exit the cord lock.

Figure 12:
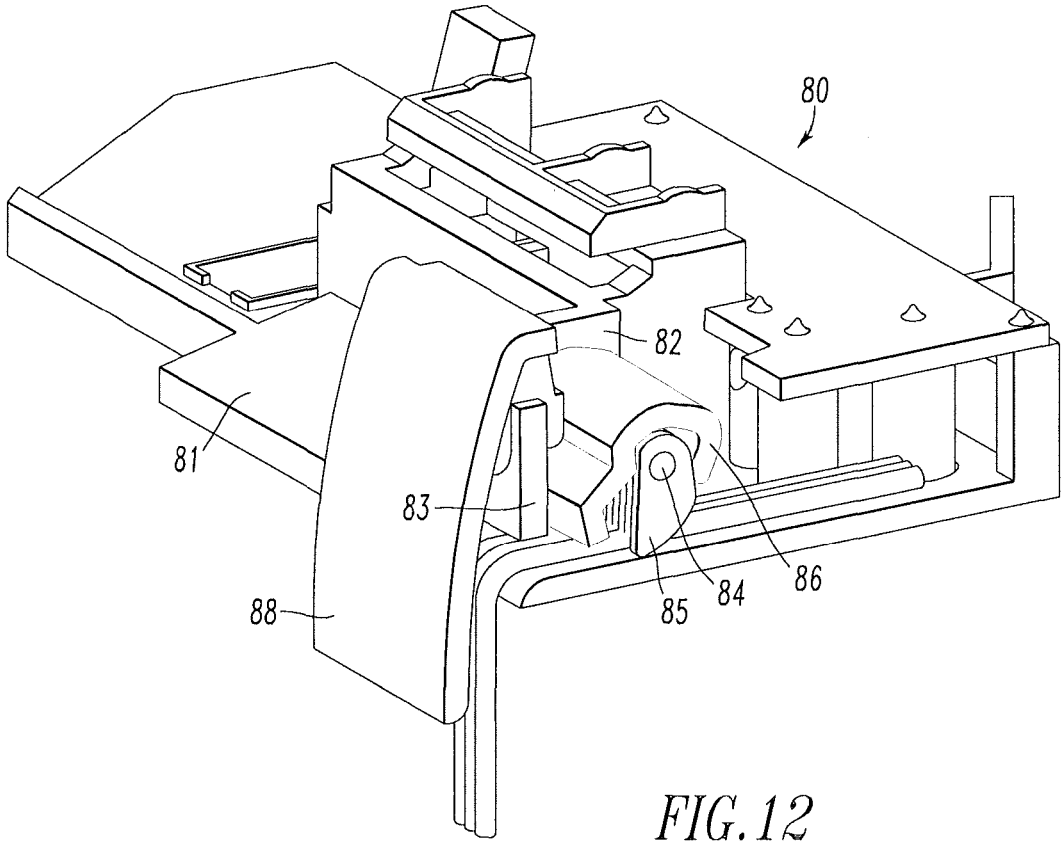
FIG. 12 is a perspective view of a fourth present preferred embodiment of our cord lock in a locked position.
Figure 13:
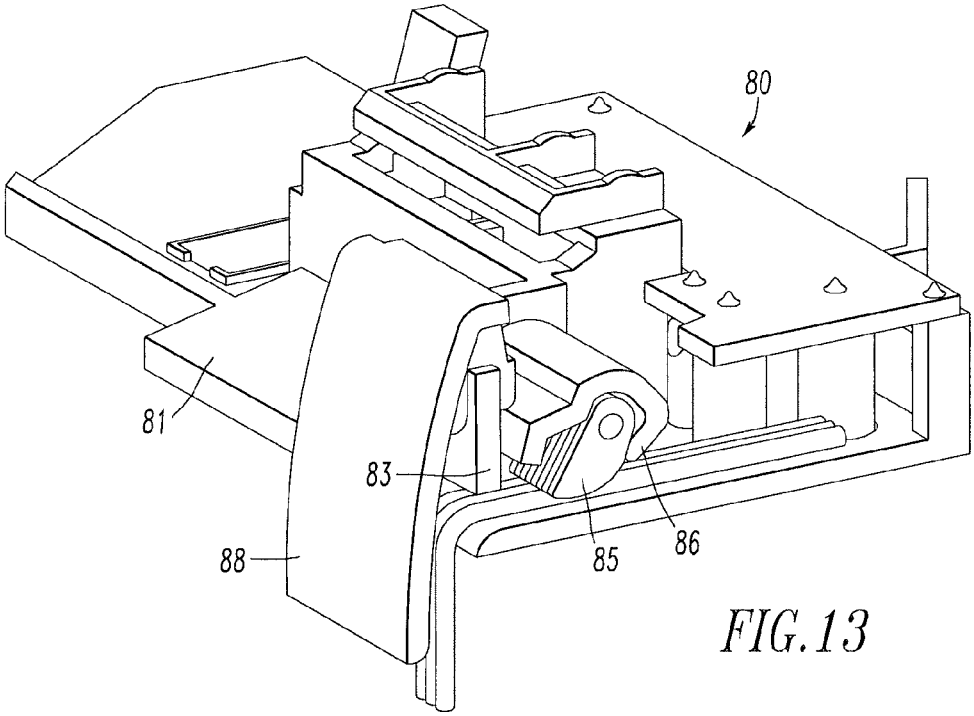
FIG. 13 is a perspective view similar to FIG. 12 of the fourth present preferred embodiment of a cord lock in a first unlocked position.
Figure 14:
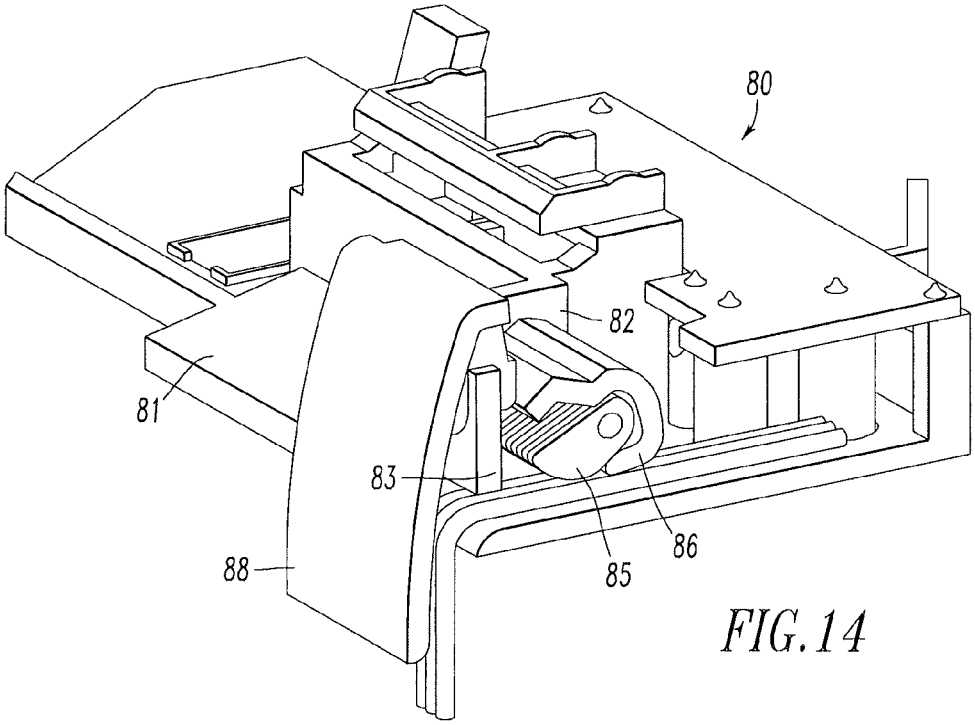
FIG. 14 is a perspective view similar to FIGS. 12 and 13 showing the fourth present preferred cord lock in a second unlocked position or release position.
Figure 15:
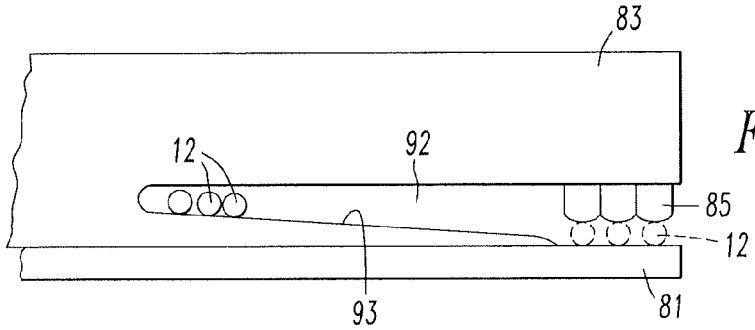
FIG. 15 is a front view of a portion of the cord lock shown in FIGS. 12, 13 and 14 showing the ramp over which the lift cords pass.
Figure 16:
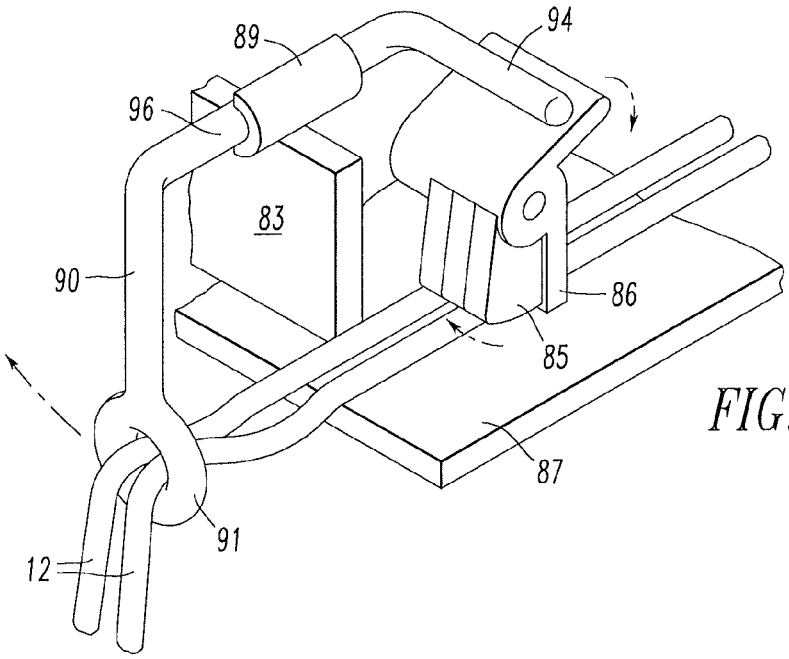
FIG. 16 is perspective view of a cam lock lift mechanism that can replace the ramp in the fourth present preferred embodiment shown in FIGS. 12 through 15.

The cord lock shown in FIGS. 12 through 14 could be alternately configured to have a release arm 90 shown in FIG. 16. A carrier 89 is attached to the top of wall 83. Release arm 90 is a bent rod or wire having two bends that define a central portion 96 that is held by the carrier 89. The front portion of the release arm has an eyelet 91 at one end of the bent rod through which the lift cords 12 pass. The opposite end of the release a in is bent to provide a trip bar portion or arm 94. When the operator moves the lift cords to the left, the central portion of the release arm rotates within the carrier and the trip bar portion moves down engaging the cam lock. As indicated by the arrows in FIG. 16, this motion causes the leading edge of the cam lock 86 to rise moving the cams to the release position shown in FIG. 14.

A fifth present preferred embodiment of our cord lock is shown in FIGS. 18, 19, 20, and 21 with the lift cords shown in dotted line. The cord lock 200 has a main body with a first portion 202 that extends into one end of a headrail (not shown) and a second portion 203 that contains the locking mechanism and face portion 206 that extends beyond the front of the headrail. Face portion 206 has an opening 204. The base of that opening is angled to have negative slope. Lift cords 12 exit the cord lock through slot 204.

The second portion 203 also houses a cord valve 207 adjacent to the opening 204. The cord valve 207 is moveable along a channel 280, and has an angled slot 208 which has positive slope. The channel 280 may be inclined, declined, or perpendicular to the cord path. In some embodiments, the channel 280 varies in width so that the channel 280 is wider or narrower at its top than it is at its bottom.

Figure 21:
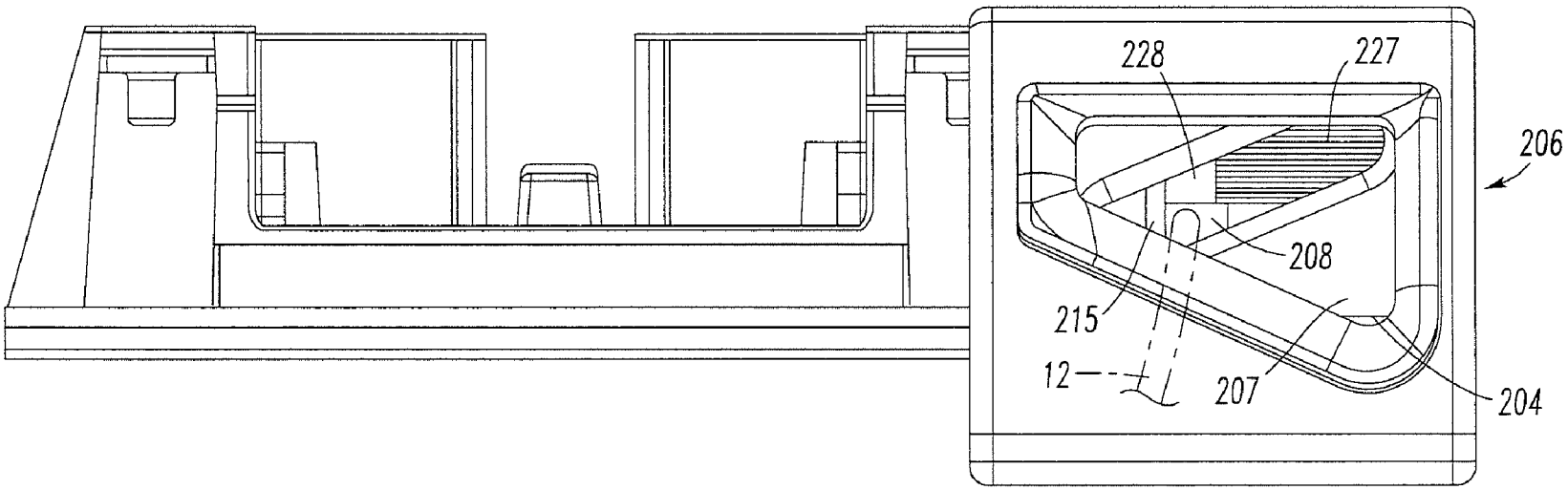
FIG. 21 is a front view similar to FIG. 18 showing the fifth present preferred cord lock in an unlocked position.

The slope of the slot 208 should be opposite to the slope of slot 204 as shown in FIG. 21. If desired, slot 208 may have a negative slope and slot 204 could have a positive slope. Slot 208 and opening 204 are both sized such that lift cords 12 can pass through them. The differences in slope ensure that lift cords passing through the both openings will cause the cord valve 207 to move up or down when the cords 12 are moved horizontally.

Behind the cord lock we provide a cam lock 219 which has at least one cam 220. In the embodiment shown in FIGS. 19 through 21 we provide a single cam 220 having teeth 227 along a portion of the bottom of the cam and a smooth portion 228. The teeth 227 are configured to enhance friction between the cam and the cord 12 so that the cam will pull itself to lock the cords 12 when they pass into the headrail. Smooth potion 228 reduces fiction so the teeth of the cam will not cause the cam to move from the unlocked position to the locked position The cam is shaped and configured to enable lift cords to easily release when pulled out of the cord lock 200 by an operator to raise the blind. An arm 223 extends from the top of the cam. The cam is positioned so that an arm 209 extending from the top of the cord valve 207 will engage the cam and help maintain it in an unlocked position. Thus, cord valve 207 functions somewhat like the release arm 90 in the embodiment of FIG. 16. Both engage the cam and maintain the cam in an unlocked position.

The cord valve 207 is free to move upward and downward along channel 280. When the lift cords 12 are locked by cam lock 219 against the locking surface 218, aim 209 of valve plate 207 rests upon a portion 221 of the cam lock 219. This forces the cam to press down on the cords and rotate into a locking position and also prevents the lift cords from being inadvertently caught between the cord valve 207 and the face portion 206. We prefer that the locking surface 218 be curved because multiple lift cords bending over a curved surface are less likely to stack one upon another than lift cords passed along a flat surface without bending. In the embodiment shown in FIGS. 18 through 21 a metal pin or roller is used to provide the locking surface. The metal pin 218 is positioned so that the lift cords 12 are deflected by the pin when the cords are moved to the low side of opening 204.

When the lift cords 12 are pulled out of the housing by a user to raise the blind, motion of the cord requires the cam 220 to rotate to an unlocked position. Movement of the lift cords to the left will raise the cam and the cord valve 207 such that the aim 209 of the cord valve will engage the arm of the cam, keeping the cam in an unlocked position.

Figure 20:
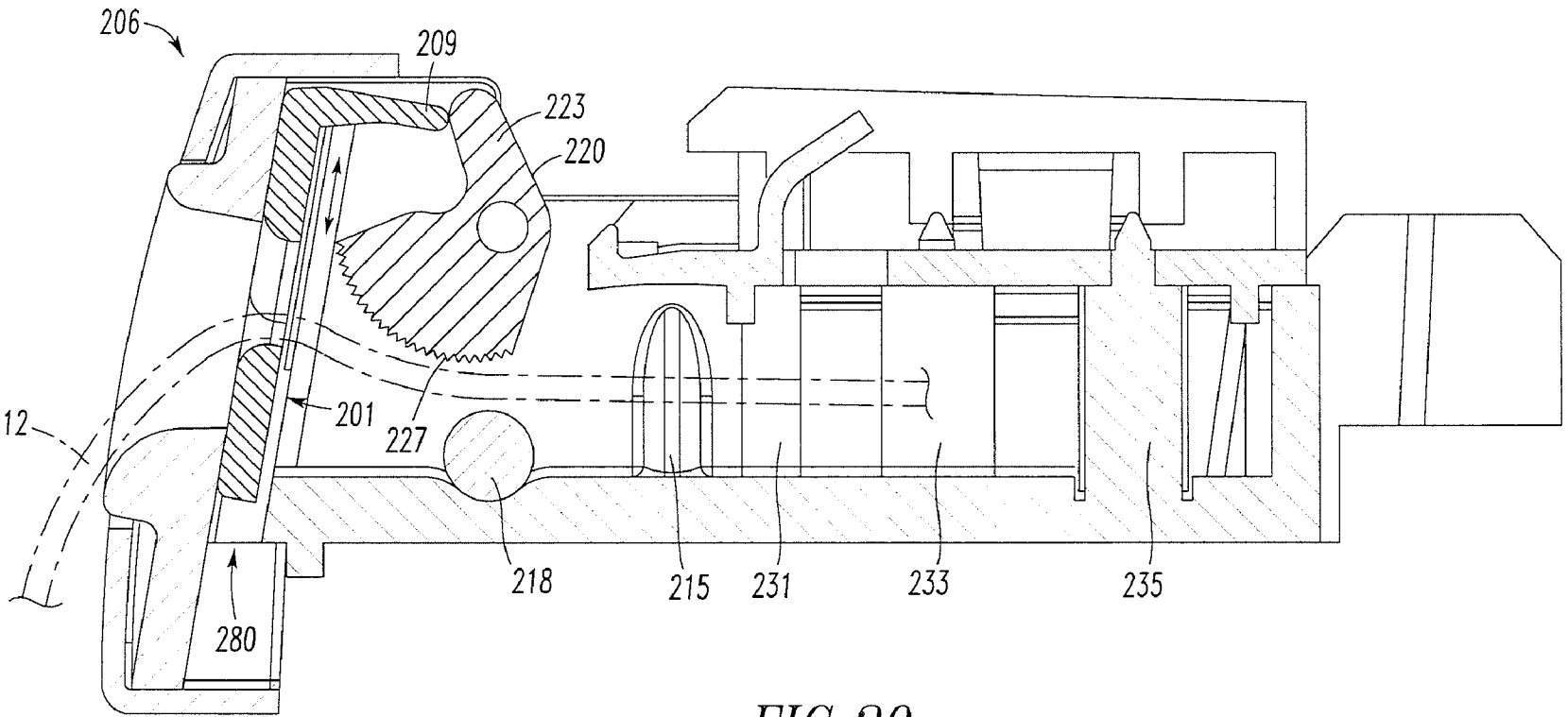
FIG. 20 is a sectional view similar to FIG. 19 showing the cord lock in an unlocked position.

To lower the blind a user moves the lift cord upwards along the ramp portion of slot 204 which is toward the left of the embodiment shown in FIG. 21. With such movement the lift cords 12 will move the cam and the cord valve 207 upwards. As the cord valve 207 moves up arm 209 engages the cam 220 and can rotate the cam to a release position, as shown in FIGS. 20 and 21. A user may move the cam to a release position by simultaneously pulling the cord out of the cord lock while moving the cord to the left. When the cam is in this release position, the lift cords are free to move in either direction which allows a user to lower the blind and is the preferred position for raising the blind as well.

Cam 220 has a smooth surface 228 positioned such that when the lift cords 12 are moved to position the cam 220 into a release position, as shown in FIGS. 20 and 21, the lift cords come into contact with the smooth surface 228. Smooth surface 228 can be seen in FIG. 21. Consequently, the lift cords pass over the smooth surface when the blind is being lowered, subjecting the lift cords to less wear than if they came into contact with teeth 227 and reducing the likelihood that the cam 220 will engage the cords 12. Although the embodiment shown in FIGS. 18 through 21 has a single cam one could use multiple cams. Specifically, a multi-cam lock similar to those shown in FIGS. 13, 14 and 16 could be used.

Figure 19:
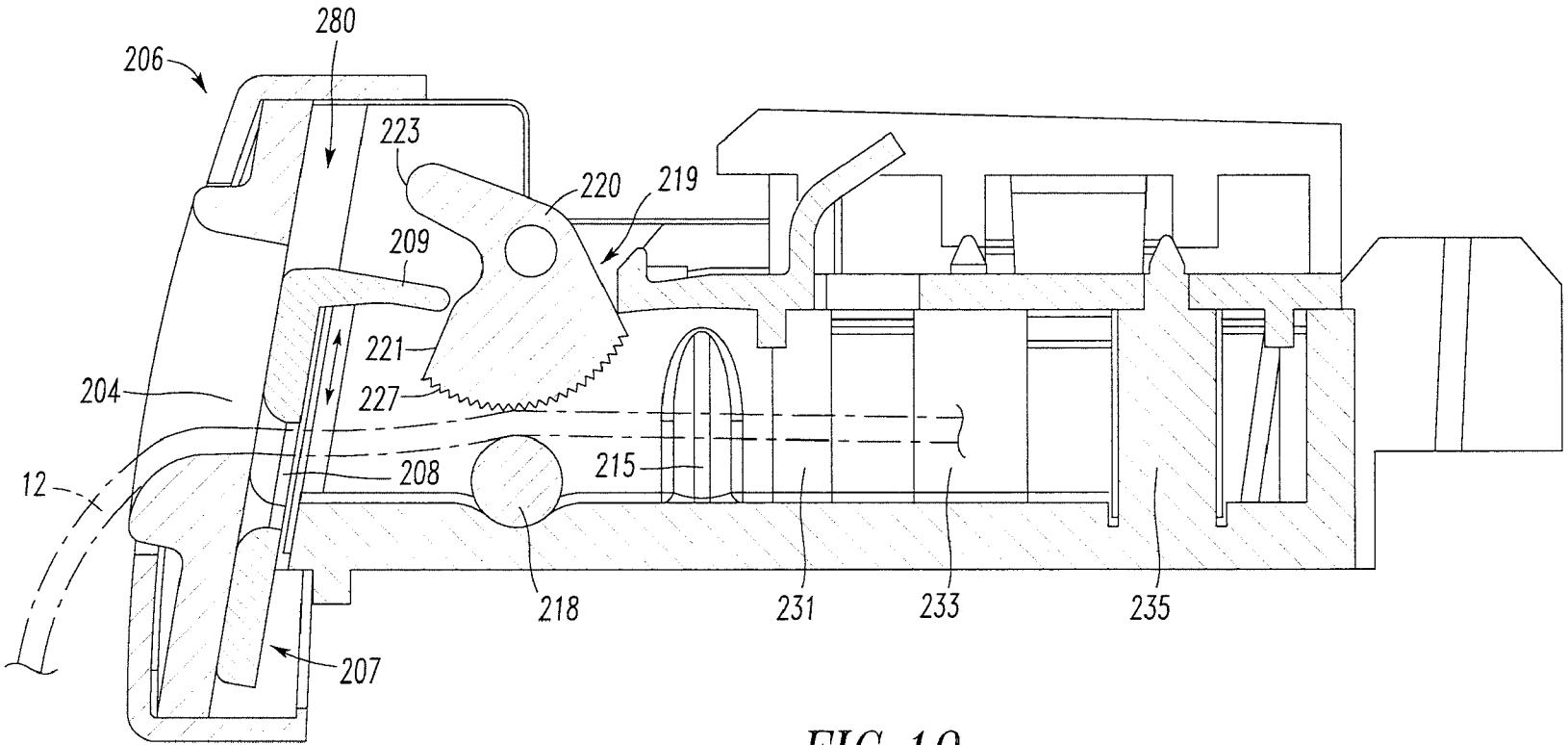
FIG. 19 is a sectional view taken along the line XIX-XIX in FIG. 18 showing the cord lock in a locked position.

A triangular extension 215 along the wall of the second portion 203 located along the cord path between the rounded corner 231 and the locking surface 218, as shown in FIGS. 19 and 20, may also be provided. This triangular extension 215 has a base that extends to the cord path providing a ramp. Lift cords 12 are positioned at the base of extension 215 when the cord lock is in a locked position, as shown in FIG. 19. When a user moves the lift cords to the left, raising cord valve 207, the lift cords travel up extension 215 to a height corresponding with the height of the lift cords as they pass through the cord valve 207 and slot 204, which makes the segment of cord extending from extension 215 to opening 204 shorter. Extension 215 makes it easier for a user to move the lift cords to the left so that the cam lock is in the release position shown in FIGS. 20 and 21 from which the user can raise or lower the blind and is preferably used for small light weight shades with two or three supple cords.

The tension or stiffness of the lift cords can affect how well the cords lift the valve and the cam for moving the cam into a release position or press down the valve for ultimately moving the cam to the locking position. For example, small light weight shades with only two supple thin cords have difficulty lifting the cam and the valve. In contrast, large heavy shades with five or six thicker cords can move the cam to an unlocked position too easily, which makes locking the cords to maintain the position of a shade more difficult. Shades with more than six cords are also often difficult to lock with a cam lock because the cords are more likely to twist into a bundle and not spread out on the locking surface.

Such problems may be largely mitigated, if not completely eliminated, by providing multiple turning surfaces at the back of the housing for redirecting the cords along the headrail. Each surface is preferably generally perpendicular to the floor of the housing and closer or farther from the end of the headrail or medial or distal to the center of the shade.

Figure 22A:
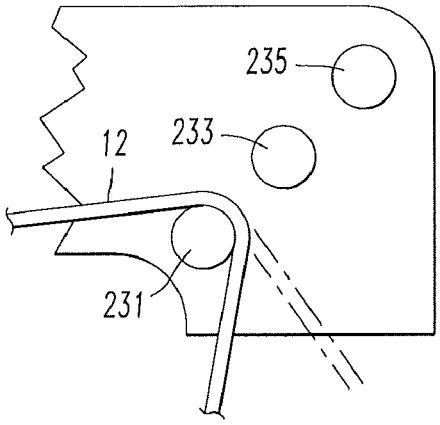
FIG. 22A shows a top view of a first present preferred cord path having cords bend along a first turning surface wherein the position of the cords is shown in solid line when the cord lock is unlocked and is shown in dotted line when the cord lock is locked.
Figure 22B:
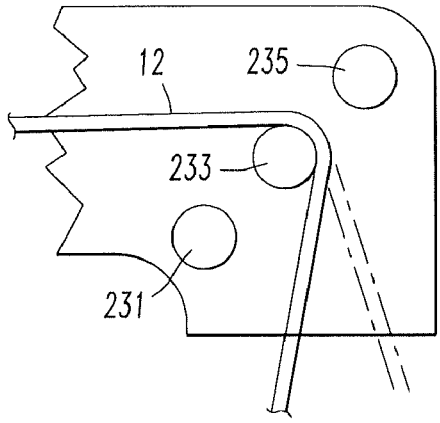
FIG. 22B is a view similar to FIG. 22A of a second present preferred cord path having cords bend along a second turning surface wherein the position of the cords is shown in solid line when the cord lock is unlocked and is shown in dotted line when the cord lock is locked.

As shown in FIG. 19, three turning surfaces, rounded corner 231 and round posts 233 and 235 are attached to the housing adjacent the cord path. Corner 231 is the most proximal to opening 204 and is more in line with the higher part of the ramp. It is also closer to the front of the lock so that the cord segment between the front ramp and the corner is shorter and requires less tension to lift the valve and cam. Bending cords along rounded corner 231, as shown in FIG. 22A, is a preferred configuration for light weight shades with two or three thin, supple cords.

Post 233 is distal to post 231 relative to opening 204 and cam 220 and aligns with a lower portion of opening 204. Medium weight shades or shades with thicker cords or four to six cords generally work better when configured to bend around post 233 because the segment of cord extending from post 233 to opening 204 is longer. This is particularly true for embodiments that do not include extension 215 to help lift the cords because the cords are more likely to stack lower on the post 233. Such a configuration creates a cord geometry that locks more easily.

Figure 22C:
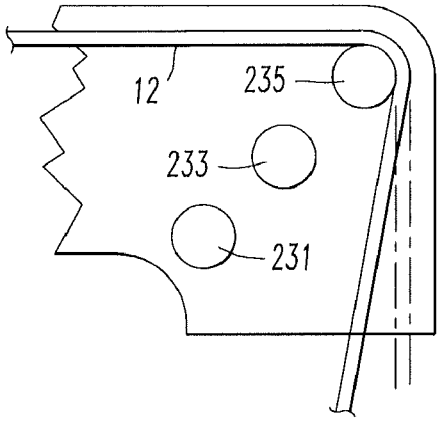
FIG. 22C is a view similar to FIGS. 22A and 22B of a third present preferred cord path having cords bend along a third turning surface wherein the position of the cords is shown in solid line when the cord lock is unlocked and is shown in dotted line when the cord lock is locked.

The cord path shown in FIG. 22C is more aligned with the lower ramp portion of the opening 204 than post 233 and the segment of cord extending from the opening to post 235 is longer than the segment extending from post 233. Configuring the cords to move along a cord path that bends along post 235 is best for thicker or stiffer cords.

Figure 22D:
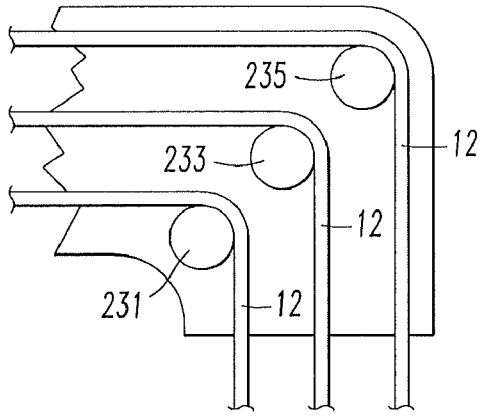
FIG. 22D is a view similar to FIGS. 22A, 22B and 22C of a fourth present preferred cord path having at least one cord bending along each of the three turning surfaces.

If a large number of cords or very thick cords are used as lift cords, it is preferred to configure the lift cords so some cords bend along respective posts 231, 233 and 235, shown in FIG. 22D. Such a configuration separates the large number of cords to make it easier to lock the multiple cords.

Figure 23:
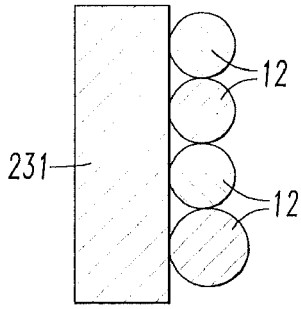
FIG. 23 is a front view of cords on a cord path bending along a turning surface such that the cords are stacked.

Cords stacked high on a post, such as the stacked cords shown in FIG. 23, or turning surface tend to lift the cam to a position where it does not easily lock. Moving the cords to a surface further from the cam reduces the angle and the height of the cords as they pass through the lock. It should be appreciated that the different cord path options provided by extension 215, posts 231, 233, 235 or other additional turning surfaces make the cord lock suitable for a great variety of shades. For example, the turning surfaces 231, 233 and 235 permit the cord lock to be used in shades that have numerous different numbers or types of cords and shade weights.

Sometimes, the stiffness of a cord may change over time as the composition of the cord fibers age or are exposed to friction or heat. Such changes to the cords may cause the lock to begin working poorly. For such occurrences, the different turning surfaces permit embodiments of the disclosed invention permit cords to be rerouted to pass through an alternate cord path by bending along a different post 231, 233 or 235 to have the cam lock work better. For example, if an operator is having difficulty locking the cords to hold the shade in a raised or stacked position, the cords could be adjusted to move along a cord path that bends along a more distal turning surface. As another example, the cords could be adjusted to bend against a turning surface that is closer to the cord lock if the operator is having difficulty moving the cord lock to an unlocked position to lower the shade or blind.

The use of oppositely sloped slots in the face and the cord valve 207 provides another benefit. Movement of the cords to the left or right moves the cord valve 207 up or down. Upward movement causes arm 209 to engage the cam and maintain the cam in a release position as previously described and as shown in FIG. 20. Using the cord valve to move the cam can permit the use of larger cams than in standard cord locks. These larger cams provide more torque and are more effective at locking cords than standard cams. For example, some embodiments may be configured so the valve travels in a plane that is tilted from perpendicular to the plane of the cord path or floor of the housing. This angled valve path 280 permits larger cams to be engaged by arm 209 of the valve since the distance between the cam and the valve increases as the cam rotates into the unlocked position. The larger the cam, the longer its travel along this arc and the greater the distance from the perpendicular. The tilted path 280 follows the arc of the cam more closely, enabling the valve arm 209 to engage the cam lobe 223.

A similar effect could be obtained if only one of the openings in the cord valve and the face portion were sloped. Moreover, use of two oppositely sloped openings can provide greater vertical movement of the cord valve 207 per unit of horizontal movement of the cords.

Prior cord locks do not use an angled opening in the face portion for lift cord openings that provide the lift cords with access into the headrail. However, use of an angled opening makes it appear that the face portion of the cord lock does not project outward from the headrail of the blind as much as a conventional cord lock of the same size. Consequently, use of a cord lock disclosed herein can enhance the appearance of the blind.

Moreover, the present cord lock projects the cords beyond the edge of the headrail, which prevents the cords from coming into contact with any window covering material that may be near the edge of the headrail or the edge of the fully or partially lowered blind. As a result, any wear that the window covering material may experience from coming into contact with the lift cords or tassels is reduced. Further, a user grabbing the tassels, or lift cords, is less likely to inadvertently grab or rub against the window covering material when attempting to operate the blind, which reduces the wear and soiling of the window covering material.

One could substitute a dog leg part for each of the cams in the illustrated embodiments. The cam configurations in those embodiments were selected over a dog leg because the selected cam configurations are shorter. One could also substitute a second cam for each roller. Then the lift cords would pass between two cams. If a second cam is used a stop should be provided to prevent the second cam from rotating 360°.

Figure 17:
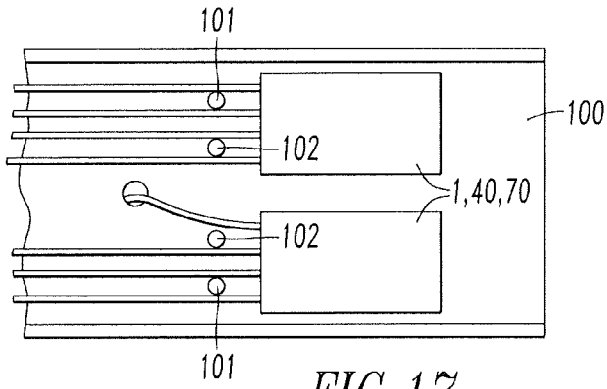
FIG. 17 is a top plan view of portion of a headrail into which two of our cord locks have been installed.
Figure 18:
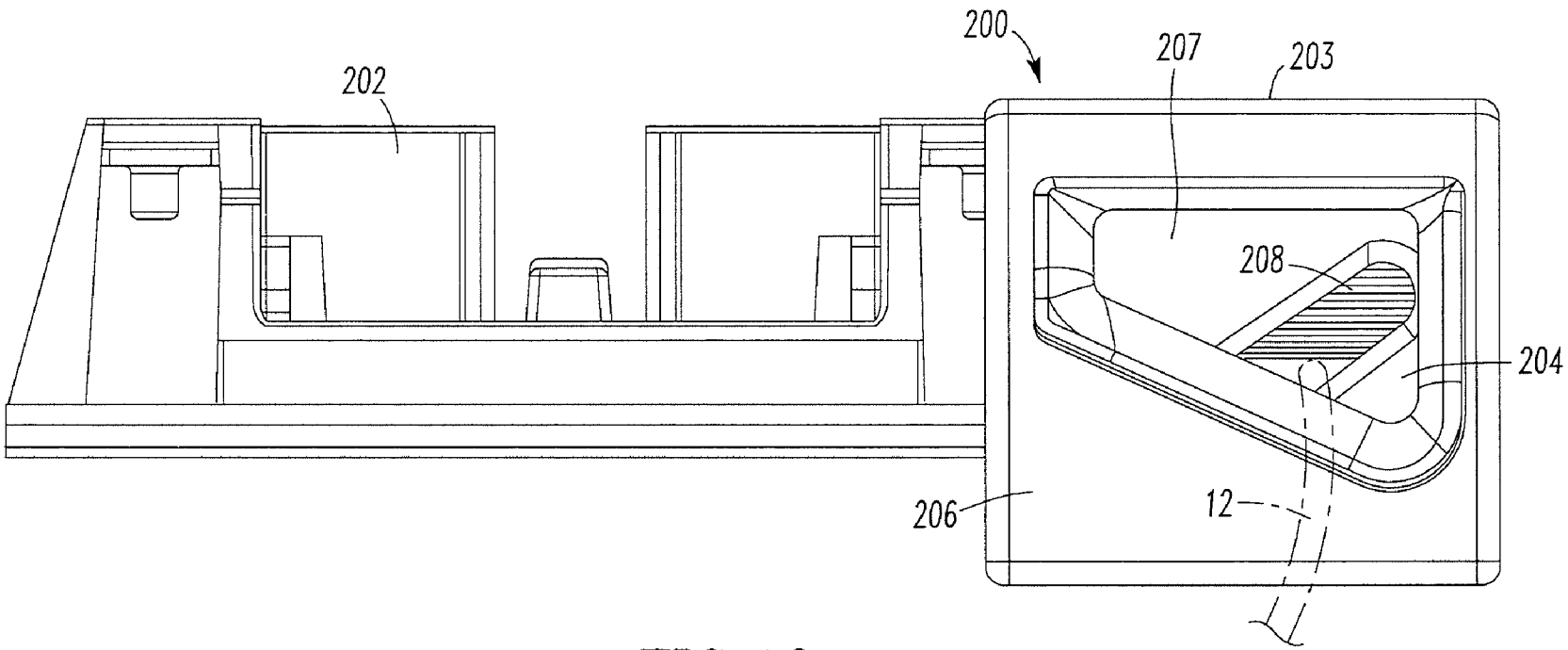
FIG. 18 is a front view of a fifth present preferred cord lock showing the fifth present preferred cord lock in a locked position.

When our cord lock 1, 40, 70, or 200 is installed in a headrail 100 as shown on FIG. 17 we prefer to provide a guide pin 101, 102 for each pair of cords. The guide pins direct the cords to positions below one of the cams. When guide pins are used in the manner shown in FIG. 17 it is unlikely that one lift cord will interfere with another lift cord or shift to a position in which two lift cords are adjacent a single cam. Two cord locks and associated pins are shown in FIG. 10, but any number of cord locks can be arranged in the headrail. When two or more cord locks are used the additional lift cords passing through one cord lock would be routed over or around the other cord locks. A single release cord (not shown) is connected to both cord locks.

It should be understood that the locking surface for our cord locks can be curved, flat, or of other irregular shapes. We prefer to use a curved locking surface because it helps prevent multiple cords from stacking onto each other when they move along the locking surface. As noted above, the stacking of multiple cords is undesirable because a cam will engage and lock the top of the stacked cords at a height that may prevent the cam from coming into contact with non-stacked cords located on the locking surface that are at a lower position than the stacked cords.

All of the components of the cord lock could be made of plastic or metal. We prefer that the cams be metal, preferably brass, so that the teeth in the cams will undergo less wear. The wheels, pins and locking drums also should be metal. The housing preferably is polycarbonate or other plastic.

While we have shown and described certain present preferred embodiments of our cord lock it should be distinctly understood that our invention is not limited thereto but may be variously embodied within the scope of the following claims.

We claim:

1. A cord lock comprising a housing having a locking surface over which a plurality of lift cords can travel along a cord path;

at least one cam positioned above the cord path and able to rotate about an axis from a locked position at which the at least one cam will engage any cord on the cord path to an unlocked position; and a release member attached to the housing, having an eyelet at one end through which any cord traveling along the cord path will pass and having a cam engaging portion at the opposite end, the release member movable by movement of any cord passing through the eyelet in the release member from a first position, in which the cam is in the locked position, to a second position at which the cam engaging portion of the release member engages the cam lock and the cam is in the unlocked position such that rotation of the release member on an axis perpendicular to the axis about which the at least on cam rotates from the first position to the second position maintains the cam in the unlocked position.

2. The cord lock of claim 1 wherein the release member is a bent rod.

3. The cord lock of claim 1 wherein the least one cam is made of plastic or metal.

4. The cord lock of claim 1 wherein the at least one cam has teeth.

5. The cord lock of claim 1 wherein the locking surface is curved.

6. The cord lock of claim 1 wherein the at least one cam is biased to the locked position.

7. The cord lock of claim 1 wherein the cam is comprised of an arm that is sized and configured to engage the cam engaging portion of the release member.

8. The cord lock of claim 1 wherein the at least one cam has a surface positioned to engage any cords passing between the locking surface and the at least one cam when the at least one cam is in the locked position, the surface having a first portion containing teeth and a second portion adjacent the first portion which is smooth.

9. The cord lock of claim 1 wherein the housing further comprises at least one turning surface adjacent the cord path.

10. The cord lock of claim 8 further comprising at least one triangular extension adjacent the at least one turning surface.

11. The cord lock of claim 1 further comprising at least one triangular extension adjacent the cord path.

12. A cord lock comprising:

a housing having a locking surface over which a plurality of lift cords can travel along a cord path;

a plurality of cams positioned above the cord path and able to rotate about an axis from a locked position at which at least one cam will engage a cord on the cord path to an unlocked position, the plurality of cams positioned relative to the cording surface in a manner such that only one lift cord may pass between each cam and the locking surface; and a release member attached to the housing, having an eyelet at one end through which any cord traveling along the cord path will pass and having a cam engaging portion at the opposite end, the release member movable by movement of any cord passing through the eyelet in the release member from a first position, in which the cam is in the locked position, to a second position at which the cam engaging portion of the release member engages the cam and the cam is in the unlocked position such that movement of the release member from the first position to the second position maintains the cam in the unlocked position.

13. The cord lock of claim 12 further comprising at least one guide pin positioned at a location on the housing opposite the plurality of cams such that the at least one guide pin will direct any plurality of lift cords on the cord path in a manner that only one lift cord passes between each cam and the locking surface.

14. The cord lock of claim 13 wherein the at least one guide pin is metal.

15. The cord lock of claim 14 wherein the metal is brass.

* * * * *